US005417249A

United States Patent [19]

Kato

[11] Patent Number: 5,417,249

[45] Date of Patent: May 23, 1995

[54] DOUBLE-LAYER SLIDE FASTENER TAPE

[75] Inventor: Hidenobu Kato, Toyama, Japan

[73] Assignee: Yoshida Kogyo K.K., Tokyo, Japan

[21] Appl. No.: 113,902

[22] Filed: Aug. 31, 1993

[30] Foreign Application Priority Data

Aug. 31, 1992 [JP] Japan ..... 4-060878 U

[51] Int. Cl.[6] ..... D03D 15/00

[52] U.S. Cl. ..... 139/384 B; 139/410; 24/393; 428/258

[58] Field of Search ..... 139/420 A, 383 A, 410, 139/384 B; 24/392, 393; 428/193, 258

[56] References Cited

U.S. PATENT DOCUMENTS

| | | | |
|---|---|---|---|
| 4,372,999 | 2/1983 | Satoo | 24/393 X |
| 4,499,927 | 2/1985 | Borel | 139/383 A |
| 4,595,627 | 6/1986 | Steinman | 428/258 |
| 5,172,456 | 12/1992 | Samberg et al. | 428/258 |

FOREIGN PATENT DOCUMENTS

| | | | |
|---|---|---|---|
| 0388835 | 9/1990 | European Pat. Off. . | |
| 0458637 | 11/1991 | European Pat. Off. . | |
| 1757114 | 12/1957 | Germany . | |
| 2655873 | 6/1978 | Germany | 139/408 |
| 62-110945 | 5/1987 | Japan | 139/420 A |
| 1041240 | 9/1966 | United Kingdom . | |
| 1590495 | 9/1990 | U.S.S.R. | 139/420 A |

*Primary Examiner*—Andrew M. Falik
*Attorney, Agent, or Firm*—Hill, Steadman & Simpson

[57] ABSTRACT

A slide fastener tape comprising: a tape body portion having a double-layer woven structure; a surface cloth woven of a plurality of yarns, which are dyeable in different degrees with a single dye, so as to form a pattern; and a lining cloth woven of yarns, which are dyeable with a dye different from the first-named dye in such a manner that said yarns dyeable with the latter dye are exposed on the majority of the outer surface of said lining cloth. On the surface cloth, the pattern is dyed in tints of the same color. On the lining cloth, a polychromic pattern is created.

3 Claims, 3 Drawing Sheets

DOUBLE-LAYER SLIDE FASTENER TAPE

BACKGROUND OF THE INVENTION

1. Field of the Invention

This invention relates to a tape woven in a double-layer woven structure, and more particular to a slide fastener tape which is different in color and pattern between front and back surfaces.

2. Description of the Related Art

There is currently known no slide fastener tape which has a double-layer woven structure with front and back surfaces different in color and pattern from each other. A tape is known (Japanese Patent Laid-Open Publication No. HEI 3-15402) on which a mark or pattern is formed by printing or by attaching a prospective mark or pattern of polyvinyl chloride resin film or flock cloth and then attaching it on the tape surface using a high-frequency or ultrasonic oscillator or a heater, or by direct electrostatic planting.

However, the known slide fastener tape mentioned in the previous paragraph took a substantial amount of time to put the mark or pattern on the tape surface because of a troublesome attaching means. Further, the finishing degree of the tape was such that a high-quality product could not be incarnated.

SUMMARY OF THE INVENTION

It is therefore an object of this invention to provide a slide fastener tape which is differentiated in color and/or pattern between front and back surfaces using a simple means and which is woven so as to form a pattern or design on each tape surface, thus incarnating a high-quality product.

According to this invention, there is provided a slide fastener tape comprising: a tape body portion having a double-layer woven structure; a surface cloth woven of a plurality of yarns, which are dyeable in different degrees with a single first dye, so as to form a pattern, and a lining cloth woven of yarns, which are dyeable with a second dye different from the first dye, in such a manner that the yarns dyeable with the second dye are exposed on the majority of the outer surface of the lining cloth.

As a specific feature, the tape has an attachment portion to which a row of coupling elements is to be attached and which has a single-layer woven structure. As another specific feature, the tape has a marginal portion opposite to the attachment portion. Each of the attachment portion and the marginal portion has a single-layer woven structure composed of yarns similar in kind to those of the surface cloth so as to form a pattern on either of opposite surfaces of the corresponding portion.

With the slide fastener tape of this invention, the tape body portion has a double-layer woven structure. Since the surface cloth, which composes one surface of the double-layer structure, is woven of plural yarns which are dyeable in different degrees with a single dye so as to form a pattern or design, it is possible to incarnate a vivid design as the woven yarns are dyed in all tints of the same color.

Further, since the lining cloth, which composes the other surface of the double-layer structure, of the tape is woven of yarns which are dyeable with other dyes, it is possible to realize a vivid dyed pattern so that the resulting tape is different in color and pattern between the front and back surfaces.

DETAILED DESCRIPTION

A slide fastener tape according to one embodiment of this invention will now be described in detail with reference to the accompanying drawings.

Figure 5:
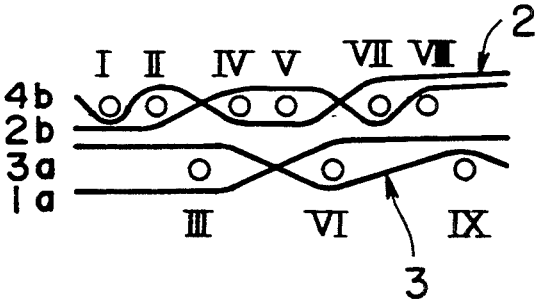
FIG. 5 is a cross-sectional view showing the running of weft yarns of FIG. 3.
Figure 6:
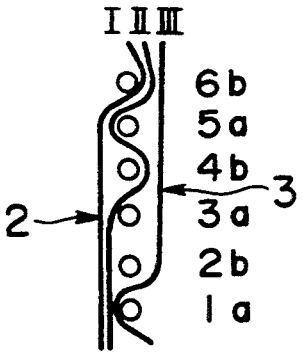
FIG. 6 is a cross-sectional view showing the running of warp yarns of FIG. 3.

In the slide fastener tape of this embodiment, a tape body portion 1 has a double-layer woven structure. As is apparent from FIGS. 5 and 6, the double-layer woven structure is a weft double-layer woven structure composed of polyester textured yarns 11 as warp yarns I, IV, VII, polyester filament yarns 12 as warp yarns II, V, VIII and rayon yarns 13 as warp yarns III, VI, IX, and polyester textured yarns 11 as weft yarns 1*a*, 2*b*, 3*a*, 4*b*. In this illustrated embodiment, the double-layer woven structure is a weft double-layer woven structure. Alternatively, it may be a warp double-layer woven structure or a warp-and-weft double-layer woven structure; in either case, the front and back layers should be connected at suitable positions.

As shown in FIGS. 3 through 6, the warp yarns I, IV, VII of the polyester textured yarns 11 and the warp yarns II, V, VIII of the polyester filament yarns, which are the same kind and have different dyeability, come out to the surface of the front cloth 2, while the warp yarns III, VI, IX different in kind from those of the polyester yarns 11, 12, namely, the rayon yarns 13 are more exposed on the surface of the lining cloth 3.

Figure 1:
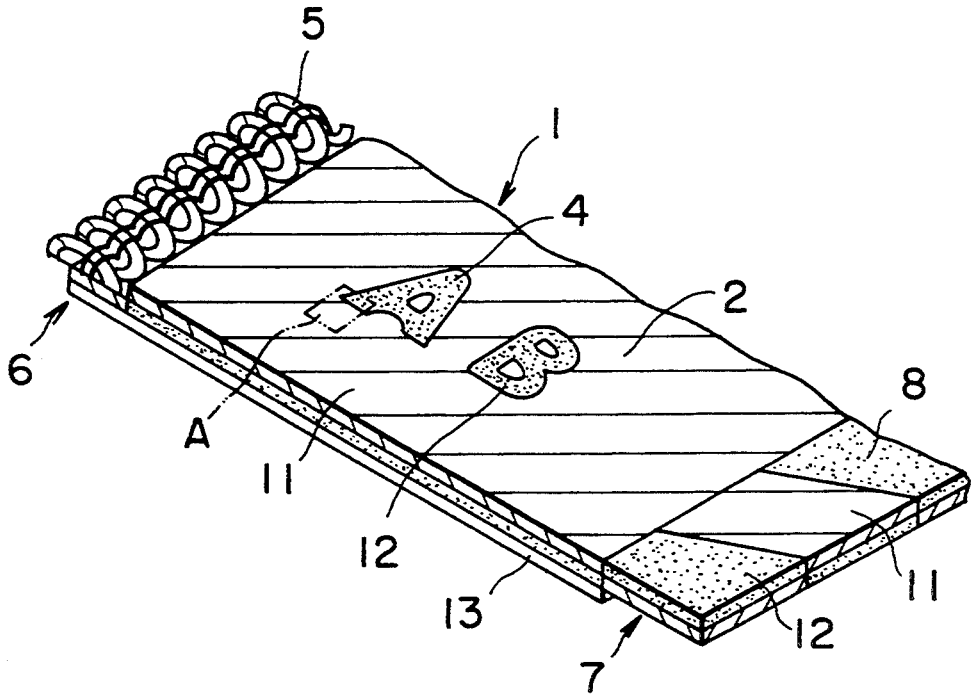
FIG. 1 is a fragmentary front perspective view of a slide fastener embodying this invention.
Figure 3:
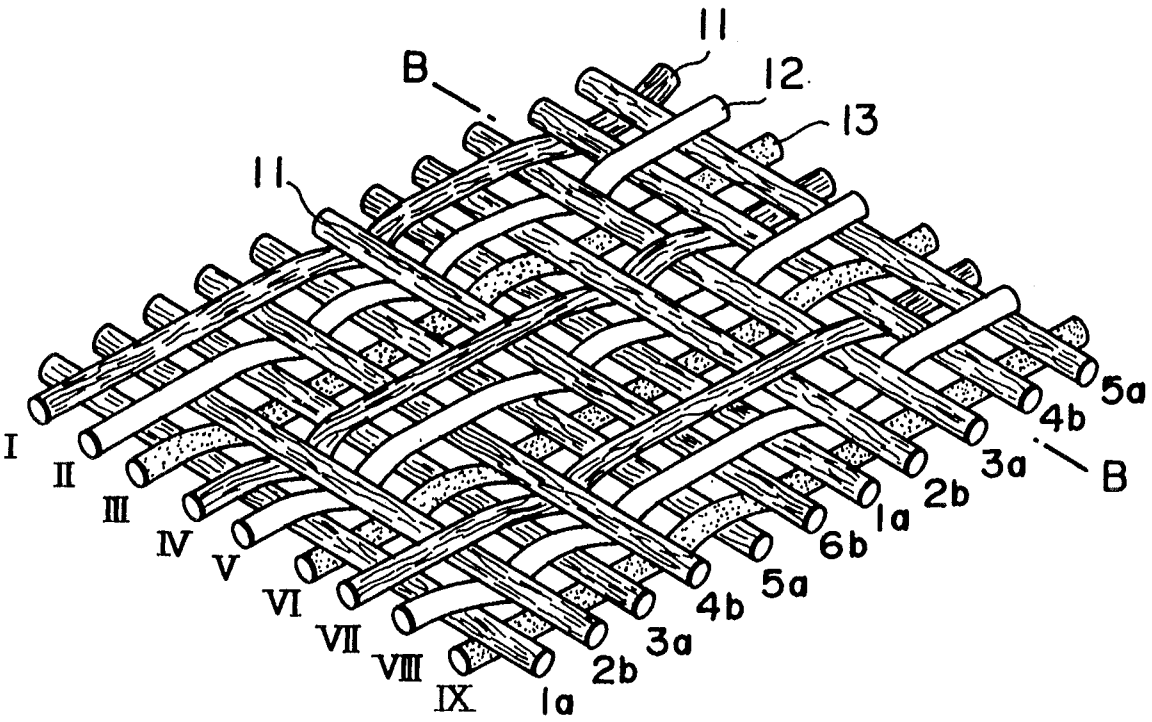
FIG. 3 is an enlarged perspective view of a portion A of FIG. 1.
Figure 4:
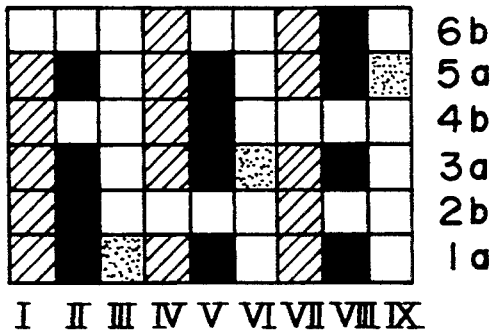
FIG. 4 is a diagram showing a cyclic base woven structure of FIG. 3.

Further, the polyester textured yarns 11 as warp yarns I, IV, VII and the polyester filament yarns 12 as warp yarns II, V, VIII are woven in the front cloth 2 in such a manner that the polyester filament yarns 12 are much more exposed at a prospective design or pattern region than the remaining woven regions to form a design or pattern 4. As shown in FIG. 3, in which a portion A of FIG. 1 is illustrated on enlarged scale, a point B represents the starting point of the pattern 4 in the woven structure, and the pattern 4 does not appear on the outer surface of the lining cloth 3. Moreover, the rayon yarns 13 as warp yarns III, VI, IX are woven in the lining cloth 3 in such a manner that the majority of the yarns 13 are exposed to the outer surface of the lining cloth 3.

The tape has along one edge an attachment portion 6 to which a row of coupling elements 5 is attached, the attachment portion 6 having a single-layer woven structure. The tape also has a marginal portion 7 along the other edge opposite to the attachment portion 6; the marginal portion 7 has a single-layer structure woven of the yarns similar in kind to those of the front cloth 2 at the tape body portion 1, namely, the polyester textured yarns 11 and the polyester filament yarns 12 so as to form a pattern 8.

Firstly when this woven tape is dyed with a dispersant dye, the polyester textured yarns 11 and the polyester filament yarns 12 are dyed. At that time, the polyester textured yarns 11 are dyed more darkly than the polyester filament yarns 12 so that these two kinds of yarns are differentiated in gradation of the same color to incarnate vivid patterns 4, 8. Meanwhile, the rayon yarns 13 unable to be dyed with this dispersant dye and are left colorless. But in the next step where the tape is soaked in a reactive dye solution, the rayon yarns 13 are dyed by printing such as ink jet printing, so that a design or pattern 9 can be dyed as a polychrome. Besides, since the reactive dye is unable to dye the polyester textured yarns 11 and the polyester filament yarns 12, it is possible to obtain a slide fastener tape which is different in color and pattern between the front and back surfaces of the tape.

Figure 2:
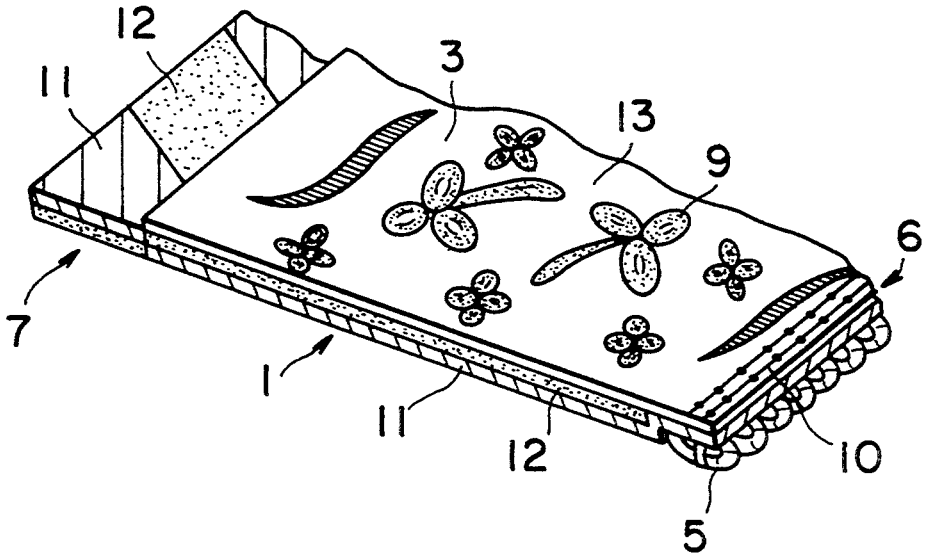
FIG. 2 Is a fragmentary rear perspective view of the slide faster.

In FIG. 2, reference numeral 10 designates sewing threads for attaching the coupling elements 5 to the tape. When the resulting tape is to be used as a slide fastener tape, it may be reversed as to the face of the tape; that is, the front cloth 2 may be on the back side and the lining cloth 3 may be on the front side.

In an alternative embodiment, the tape is woven of three kinds of yarns, i.e., polyester textured yarns, bright cation dyeable polyester yarns and rayon yarns. In the front cloth of the tape, the warp yarns are polyester textured yarns and bright cation dyeable polyester yarns, while the weft yarns are polyester textured yarns; the front cloth has a woven structure such that the bright cation dyeable polyester yarns are exposed to form a majority of the design or pattern. In the lining cloth, polyester textured yarns are used as weft yarns while rayon yarns are used as warp yarns; the lining cloth has a woven structure such that the majority of the rayon yarns are exposed to the outer surface of the cloth. Firstly when the tape is dyed with a dispersant dye, the polyester textured yarns are dyed faintly and the bright cation dyeable polyester yarns are dyed deeply. And nextly, by dyeing with a cation dye, only the bright cation dyeable polyester yarns are dyed more deeply, so that a vivid design or pattern can be incarnated. Finally when the tape is dyed with a reactive dye, it is possible to obtain a slide fastener tape which is different in color and pattern between the front and back surfaces.

The slide fastener tape thus obtained has the following advantageous results.

The tape body portion has a double-layer woven structure. Since the surface cloth is woven of plural yarns which are dyeable in different degrees with a first dye so as to form a design or pattern, the design or pattern can be formed on the surface cloth by plural yarns, so that it is possible to incarnate a design or pattern vividly in tints of the same color. Meanwhile, the lining cloth is woven of yarns dyeable with a second dye in such a manner that the majority of the yarns dyeable with the second dye will come out to the outer surface of the linen cloth, thus giving the tape a high-quality touch.

Also, since the lining cloth can be dyed with a reactive dyes so as to have a polychromic design or pattern, it is possible to manufacture a variety of tapes with ease so that application of slide fasteners will be increased.

Furthermore, partly since both of the attachment portion to which the coupling elements are to be attached, and the marginal portion opposite to attachment portion have a single-layer woven structure and partly since the front and back layers of either portion are stably joined together, it is possible to secure firmly attaching of coupling elements so that a slide fastener which is steady and has a tidy appearance can be obtained with ease.

What is claimed is:

1. A slide fastener tape comprising:

a tape body portion, said body portion holding a slide fastener coupling means at least partially along a length thereof, and said body portion having a double-layer woven structure which includes, (a) a surface cloth woven of a plurality of yarns, which are dyeable in different degrees with a single first dye, so as to form a pattern; and (b) a lining cloth woven of yarns, which are dyeable with a second dye which is different from the first dye, in such a manner that said yarns dyeable with said second dye are exposed on the majority of an outer surface of said lining cloth.

2. A slide fastener tape comprising:

a tape body portion, said body portion having an attachment portion holding a slide fastener coupling means at least partially along a length thereof, and said body portion having a double-layer woven structure adjacent said attachment portion which includes, a surface cloth woven of a plurality of yarns, which are dyeable in different degrees with a single first dye, so as to form a pattern;

a lining cloth woven of yarns, which are dyeable with a second dye which is different from the first dye, in such a manner that said yarns dyeable with said second dye are exposed on the majority of an outer surface of said lining cloth; and said attachment portion having a single-layer woven structure.

3. A slide fastener tape comprising:

a tape body portion, said body portion having an attachment portion holding a slide fastener coupling means at least partially along a length thereof, and said body portion having a double-layer woven structure adjacent said attachement portion which includes, a surface cloth woven of a plurality of yarns, which are dyeable in different degrees with a single first dye, so as to form a pattern;

a lining cloth woven of yarns, which are dyeable with a second dye which is different from the first dye, in such a manner that said yarns dyeable with said second dye are exposed on the majority of an outer surface of said lining cloth; and a marginal portion opposite to said attachment portion, each of said attachment portion and said marginal portion having a single-layer woven structure composed of yarns similar in kind to those of said surface cloth so as to form a pattern on either of opposite surfaces of the respective attachment and marginal portions.

* * * * *